United States Patent [19]

Norgate

[11] 4,444,037

[45] Apr. 24, 1984

[54] MANUFACTURE OF ROOFING OR CLADDING TILES

[75] Inventor: Robert B. Norgate, Hamilton, New Zealand

[73] Assignee: Hunter Douglas Industries B.V., Rotterdam, Netherlands

[21] Appl. No.: 318,311

[22] Filed: Nov. 4, 1981

[51] Int. Cl.[3] ..... B21D 11/18

[52] U.S. Cl. ..... 72/177; 72/414

[58] Field of Search ..... 72/414, 177, 184, 385, 72/379, 412

[56] References Cited

U.S. PATENT DOCUMENTS

| | | | |
|---|---|---|---|
| 1,814,593 | 7/1931 | Gersman | 72/385 |
| 2,359,650 | 10/1944 | Kelleher | 72/414 |
| 4,250,728 | 2/1981 | King | 72/385 |
| 4,320,648 | 3/1982 | Ekmark | 72/379 |

FOREIGN PATENT DOCUMENTS

| | | | |
|---|---|---|---|
| 115037 | 11/1900 | Fed. Rep. of Germany | 72/385 |
| 1022717 | 3/1966 | United Kingdom | 72/385 |

*Primary Examiner*—Gene P. Crosby

*Attorney, Agent, or Firm*—Pennie & Edmonds

[57] ABSTRACT

A method and a die tool is disclosed for forming longitudinally and laterally extending tile impressions in a strip of material in which the die tool comprises first and second cooperating parts formed as a unitary structure and each including a first section whose length is equivalent to the length of at least one tile main surface area plus the length of the stepped portion of the tile to be impressed, a single stepped portion and a second section having a complementary surface area generally parallel to the surface area of the first section. The surface areas of the first and second sections each have longitudinally extending ornamentations thereon as does the stepped portion, whereby a tile pattern can be impressed on a strip of material when the material is sandwiched between the first and second parts of the die tool.

8 Claims, 10 Drawing Figures

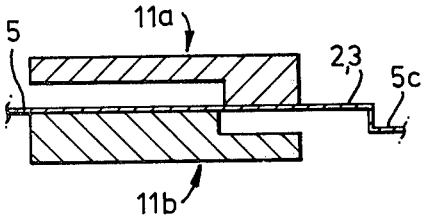
Fig. 5(iii).

MANUFACTURE OF ROOFING OR CLADDING TILES

This invention relates to a die tool and to a method of using the die tool in the manufacture of roofing or cladding tiles in continuous strip form from flat sheet metals.

Roofing materials in long run continuous form are used extensively today and this type of roofing and cladding material is known to have advantages over alternative materials. The main advantage of strip form roofing and cladding material is that it can be produced and placed economically by comparison with single tiles or shingles of, for example, concrete or other materials. However, the aesthetic appeal of these types of material is not agreeable to everyone and there is a growing demand for materials which, although in strip form, give the appearance of being composed of a number of individual tiles or shingles. The manufacture of such a sheet material presents problems in that in order to impress tile impressions on a sheet material it is necessary to provide a number of bends in the material within a relatively small area. This creates problems in that a material impressed using methods hitherto known results in localised stretching and stress concentrations throughout the impressed material and subsequent weaknesses.

According to the present invention there is provided a die tool for forming longitudinally and laterally extending tile impessions on a strip of material, said die tool comprising first and second cooperating die parts or units, each of said parts being formed as a unitary structure and including:

(a) a first section having a surface area whose length is equivalent to the length of at least one tile main surface area plus the length of a stepped portion of a tile to be impressed;

(b) a single stepped portion;

(c) a second section having a surface area generally parallel to said surface area of said first section, and wherein the surface area of said first and second sections have longitudinally extending ornamentation thereon and wherein the surface area of the stepped portion is ornamental, the surface areas of the first and second sections and stepped portions of one die part being complementary to the first and second sections and stepped portion of the other die part, effective to impress a tile pattern in a strip of material when such material is sandwiched between the first and second parts of the die tool.

Such a die tool goes some way to overcoming the above mentioned problems involved in producing an impressed roofing and/or cladding material.

The invention further provides a method of forming longitudinally and laterally extending impressions in a strip of material, said method comprising the steps of:

(i) providing a die tool according to the invention;

(ii) advancing said strip of material between the oppositely disposed and complementary surface areas of said die tool parts;

(iii) closing the two die tool parts together and sandwiching the advance portion of the strip between the two parts of the die tool to provide at least the final deformation of the longitudinally extending tile impressions and to form a stepped portion in the strip material.

The strip material is preferably initially flat. It is contemplated that the method could further comprise the step of preforming the majority of the deformation necessary to provide the longitudinally extending tile impressions by feeding the strip between preforming rolls. Thus, only the final deformation of sheet material to provide the longitudinally extending tile impressions would be carried out by the die tool parts.

Alternatively, the longitudinally extending tile impressions are formed solely be closing together of said two die tool parts.

In order that the invention may more readily be understood, the following description is given, merely by way of example, reference being made to the accompanying drawings, in which:

FIG. 1 is a part perspective view of a typical example of roofing material which can be made by the method of the invention;

FIG. 1*a* is a similar view of another example of such material;

Figure 6:
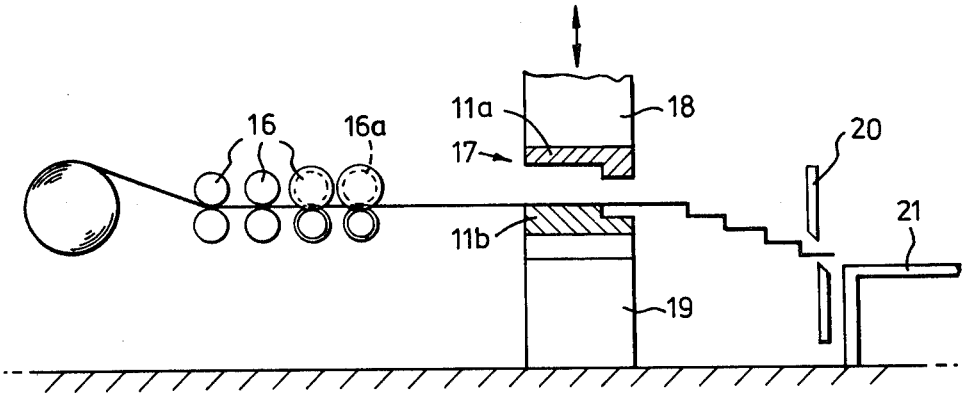
Figure 5I:
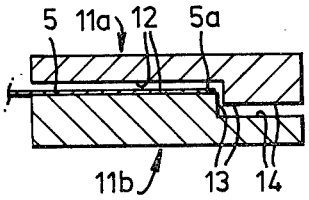
Figure 5:
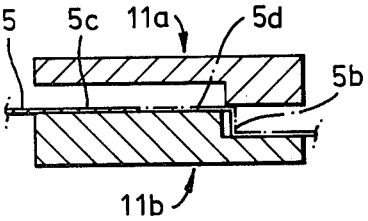
Figure 5:
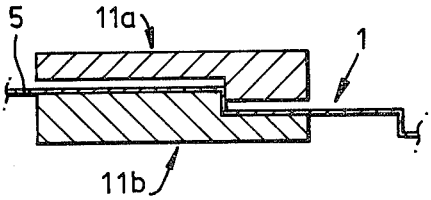

FIGS. 5(*i*)–(*iv*) are diagrammatic cross-sectional views illustrating steps during the method of the present invention; and FIG. 6 is a diagrammatic drawing of a typical arrangement for an apparatus using a die tool in accordance with the present invention.

Figure 1:
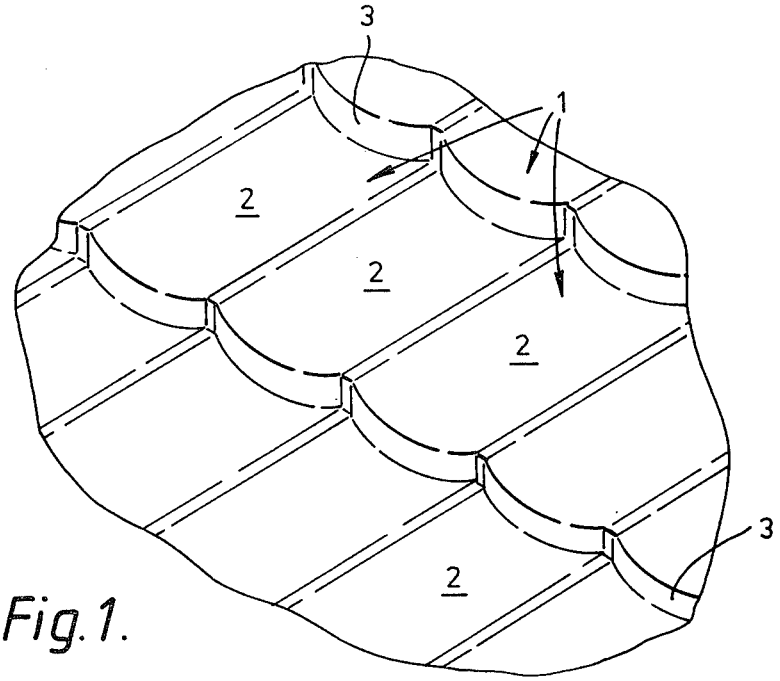
Figure 1A:
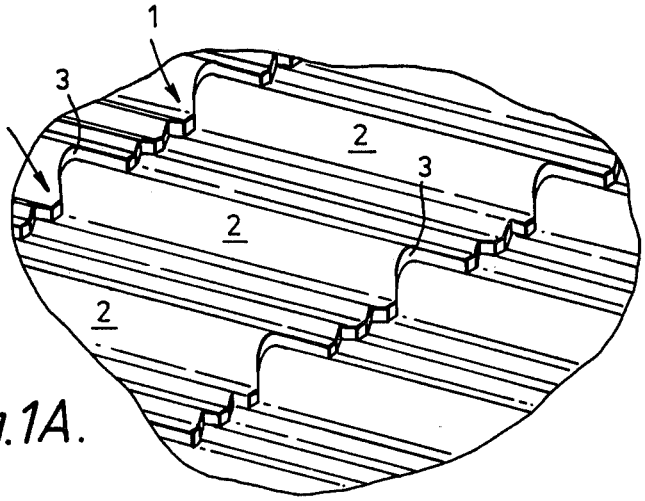

FIGS. 1 and 1*a* illustrate two examples of roofing material which can be manufactured in long-run lengths from a strip of flat material such as galvanised iron or aluminium. The strip material has a plurality of tile impressions formed therein by a cold pressing process. For this kind of sheet material longitudinally and laterally extending impressions are made in a flat sheet so that the finished product, though being in strip form, gives the impression of comprising a number of individual shingles or tiles as is indicated by arrow 1. Each tile impression 1 can comprise a main tile surface area 2, and a step 3, and the main surface areas 2 and/or the steps 3 of each individual tile impression 1 may have decorative ridges or corrugations formed thereon.

Figure 2:
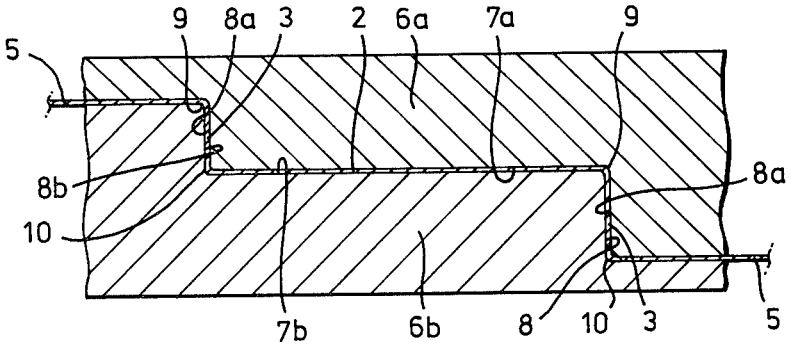
FIG. 2 is a diagrammatic end view of a set of die tools typical of those as is known in the art, for making material similar to that of FIGS. 1 and 1*a;*

FIG. 2 of the drawings shows a typical die tool arrangement as is known in the art for pressing out tile impressions 1 from a flat strip of material 5. Complementary die tool parts or units 6*a* and 6*b* are provided with opposite faces 7*a* and 7*b* having complementary ornamental surface configurations and/or patterns therein adapted to produce the desired tile impression 1 on a strip material. For the known method of manufacture it is usual for the lower die tool part 6*b* to be stationary and the upper die tool part 6*a* is adapted for vertical movement up and down relative to the lower die tool 6*b* during which time the impressions 1 are stamped upon the sheet material 5 and the material is periodically moved forward so that a row of tile impressions 1 can be formed when the two die tool parts 6*a* and 6*b* are brought together sandwiching a strip of material therebetween. This method is carried out in one action and consequently a number of stress concentrations are formed in this stamped out material 5, the most serious of these being in areas 9 and 10 adjacent the step portions 3 of the material 5.

Figure 3:
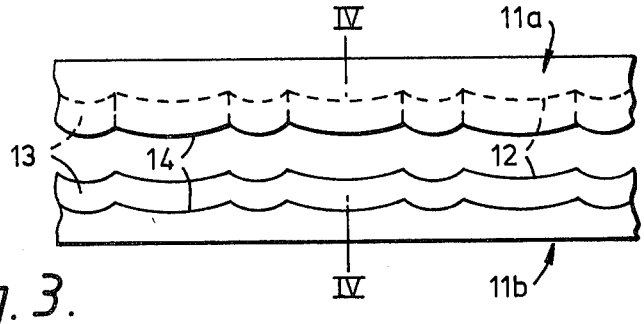
FIG. 3 is a diagrammatic end view of one embodiment of die tool in accordance with the present invention; shown in the open position.
Figure 4:
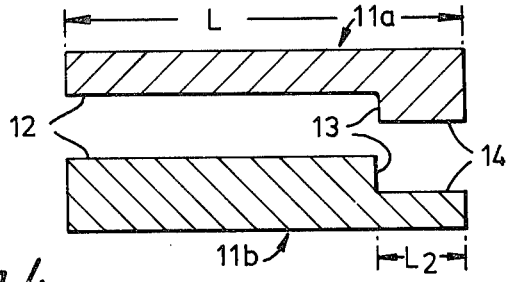
FIG. 4 is a cross-section taken along the line IV—IV of FIG. 3.

FIGS. 3 and 4 of the drawings illustrate a set of die tools 11*a* and 11*b* in accordance with the present invention which are similar in most respects with the die tools known in the art and illustrated by FIG. 2 in that upper and lower die tool parts 11*a* and 11*b* are provided each having a first section 12. However, the tool parts have only one ornamental stepped portion 13 and a second lower section 14.

Further and with particular reference to FIG. 4 of the drawings, whereas for the known die tools such as those illustrated by FIG. 2 the length of the portion 7*a* and 7*b* are substantially equivalent to the length of the main surface area 2 of one tile impression stamped therefrom, the first section 12 of the die tools in accordance with the present invention are substantially longer than those of die tools known in the art, that is, the length "L" shown in FIG. 4 can be two to three times longer than the length of a main surface area 2 of a tile impression 1 to be stamped from the die tool parts 11*a* and 11*b* of the present invention, and the length $L_2$ of the second area 14 below the main surface area 12 of the die tool parts 6*a* and 6*b* is less than the length of a main surface area 2 of a tile impression stamped therefrom. The length of the stepped portion 13 of the die tool parts 11*a* and 11*b* is substantially equivalent to the length of the step 3 of a tile impression to be stamped.

The contact surfaces 12, 13 and 14 of the die tool parts 11*a* and 11*b* of the present invention can be machined from steel or metal and be provided with a coating of plastics material such as "Lurethane" which is hardwearing but which has the desirable characteristic of being sufficiently elastic to allow the pressing of a prepainted strip of material without damaging galvanised or painted surfaces thereof.

FIGS. 5(*i*) to 5(*iv*) illustrate the steps during the manufacture of an impressed strip of material at a station where the die tool parts are situated. The method can begin at the instance illustrated by FIG. 5(*i*). At this instance an end portion 5*a* of the sheet material 5 has been fed between the first sections 12 of the die tool parts 11*a* and 11*b* and the free end of the sheet material is stopped short of the stepped portions 13 of the die tool parts. The die tool parts 11*a* and 11*b* can then be closed so that the portion 5*a* of the sheet material is preformed to the general longitudinal surface ornamentation of the final product.

At the instance illustrated by FIG. 5(*ii*) the die tool parts 11*a* and 11*b* have opened and the sheet material is advanced a predetermined distance, the preformed end portion 5*a* of the material being indicated in dotted outline. The die parts 11*a* and 11*b* can then be brought together with the strip material sandwiched in between and a first stepped portion 5*b* is produced in the strip material and at the same time a further portion 5*c* adjacent portion 5*a* of the strip material which was previously flat is preformed.

At the instance illustrated by FIG. 5(*iii*) the die tool parts 11*a* and 11*b* are open and the sheet material is advanced a distance equivalent to the length of one main surface area 2 of a tile impression to be formed plus the length (depth) of one stepped portion 3 thereof.

At the instance 5(*iv*) the die tool parts 11*a* and 11*b* have again been brought together and this completes a first complete tile impression 1, and the latter process steps can be repeated indefinitely.

It has been found that where a section at least equivalent to one main tile area length plus the length (depth) of a step in the tile are preformed before the stepped portions are impressed in the strip material results in a substantial reduction of weak "stressed" areas in the final product.

FIG. 6 of the drawings illustrates diagrammatically an apparatus for carrying out the process aforedescribed. Such apparatus can comprise a source of sheet material 15 at position I which can be in a roll form, a set of feed rollers 16 at position II, a press 17 at position III comprising an upper reciprocal head portion 18 to which a die tool part 11*a* can be attached and a lower fixed base portion 19 to which die tool part 11*b* may be attached. A pair of shears 20 or other cutting means can be positioned at IV and a stacking table 21 or the like at position V.

Each advance of the material 5 from the roll 15 may be controlled by a geared or other indexing system associated with feed rollers 16, and such indexing system may be synchronised with a reciprocal movement of the head 18 having a top die tool 11*a* fixed thereto and the cutting means 20.

The forming of the longitudinal ornamentation of a main surface area is shown carried out entirely by the die tool parts. If desired at least feed rolls 16 nearer to the press 17 could be profiled, as shown at 16A to provide some, and indeed nearly all, of the longitudinally extending ornamentation. The final ornamentation will still be provided by the die tool parts.

I claim:

1. A method of forming longitudinally and laterally extending tile impressions in a strip of material comprising the step of:

(i) providing a die tool comprising first and second cooperating die parts, each of said parts being formed as a unitary structure and including:

(a) a first section having a surface area whose length is equivalent to the length of at least one tile main surface area plus the length of a stepped portion of a tile to be impressed;

(b) a single stepped portion;

(c) a second section having a surface area generally parallel to said surface area of said first section, and wherein the surface area of said first and second sections have longitudinally extending ornamentation thereon and wherein the surface area of the stepped portion is ornamental, the surface areas of the first and second sections and stepped portions of one die part being complementary to the first and second sections and stepped portion of the other die part, effective to impress a tile pattern in a strip of material when such material is sandwiched between the first and second parts of the die tool;

(ii) advancing said strip of material between the oppositely disposed and complementary surface areas of said die tool parts, whereby a forward end of the material is positioned just short of the stepped portions of the two die tools and an advanced portion of the strip material overlies and underlies the first sections of the two die tools;

(iii) closing the die tools and sandwiching the advance portions of the strip material between the ornamental and complementary first sections of the two die tools to preform the strip of material to the general longitudinal surface ornamentation of the tile to be impressed;

(iv) moving the die tools apart and advancing the strip of material further so that a portion of the strip which has previously been preformed extends forwardly of the stepped portions of the die tool parts;

(v) closing the two die tool parts together and sandwiching the advance portions of the strip between the two parts of the die tool to provide at least the final deformation of the longitudinally extending tile impressions and to form a stepped portion of the strip material.

2. A method as claimed in claim 1, wherein the step (v) is used to form a first flange in the strip material and the steps (iv) and (v) are thereafter repeated, the strip material being advanced during step (iv) after the first flange has been formed by a length equivalent to the length of one tile main surface area plus the length of the stepped portion of a tile to be impressed.

3. A method of forming longitudinally and laterally extending tile impressions in a strip of material comprising the steps of:

(i) providing a die tool comprising first and second die units, each comprising taken in the feed direction of the strip material:

(a) a first section preceding a step forming location;

(b) a single stepped portion;

(c) a second section succeeding the step forming location, whereby the first sections of the die units have a surface area whose length is at least the length of one tile main surface area plus the length of a stepped portion of a tile to be impressed;

and the second sections of the die units have a surface area generally parallel to said surface area of said first sections and wherein the surface area of said first and second sections have longitudinally extending ornamentation thereon and wherein the surface area of the stepped portion is ornamental, the surface areas of the first and second sections and stepped portion of one die unit being complementary to the first and second sections and stepped portion of the other die unit, effective to impress a stepped tile pattern in a strip of material;

(ii) advancing said strip of material between the oppositely disposed and complementary surface areas of said die tool units whereby an advanced portion of the material is positioned just short of the stepped portions of the two die tools and said advanced portion of the strip material overlies and underlies the first sections of the two die units, (iii) closing the die tool by pressing the two die tool units together and sandwiching said advanced portion of the strip material between the ornamental and complementary first sections of the two die tool units to preform the strip of material to the definite general longitudinal surface ornamentation of the tile to be impressed;

(iv) moving the die tools apart and advancing the strip of material further so that said advanced portion of the strip which has previously been so preformed is properly positioned with respect to the stepped portions of the die tool units for being definitely formed including being given lateral impressions;

(v) closing the two die tool units together and sandwiching said advanced portion of the strip between the two units of the die tool to provide the final formation of the longitudinally extending tile impressions and that of the lateral impression forming the stepped portion of the strip material.

4. A method as claimed in claim 3 whereby said advanced portion is formed by a forward free end of a strip of strip material.

5. A method as claimed in claim 3, wherein the method of claim 9 is performed in a repetitive manner and the strip material is part of a continuous supply of strip material.

6. A method as claimed in claim 3, wherein the strip material is initially flat and further comprising the step of preforming the majority of the deformation necessary to provide longitudinally extending tile impressions by feeding the strip between preforming rolls.

7. A die tool for forming longitudinally and laterally extending tile impressions on a strip of material, said die tool comprising cooperating first and second die units, each comprising, taken in the feed direction of the strip material:

(a) a first section preceding a step forming location;

(b) a single stepped portion;

(c) a second section succeeding the step forming location, whereby the first sections of the die units have a surface area whose length is at least the length of one tile main surface area plus the length of a stepped portion of a tile to be impressed;

and the second sections of the die units have a surface area generally parallel to said surface area of said first sections and wherein the surface area of said first and second sections have longitudinally extending ornamentation thereon and wherein the surface area of the stepped portion is ornamental, the surface area of the first and second sections and stepped portion of one die unit being complementary to the first and second sections and stepped portion of the other die unit, effective to impress a stepped tile pattern in a strip of material.

8. A die tool as claimed in claim 7, wherein the length of the said second portion of each die tool unit is less than the length of one tile main surface area of a tile to be impressed.

* * * * *